US011649773B2

(12) United States Patent
Göransson et al.

(10) Patent No.: US 11,649,773 B2
(45) Date of Patent: May 16, 2023

(54) CONTROL DEVICE AND METHOD FOR CONTROLLING A COMPRESSION RELEASE BRAKE ARRANGEMENT FOR AN ENGINE

(71) Applicant: Scania CV AB, Södertälje (SE)

(72) Inventors: Hans Göransson, Älvsjö (SE); Erik Ersvik, Lidingö (SE); Lars-Göran Kjellström, Hägersten (SE); Mats Ekman, Nykvarn (SE); Erik Höckerdal, Södertälje (SE); Joakim Sommansson, Grödinge (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 17/619,172

(22) PCT Filed: Jun. 10, 2020

(86) PCT No.: PCT/SE2020/050597
§ 371 (c)(1),
(2) Date: Dec. 14, 2021

(87) PCT Pub. No.: WO2021/006787
PCT Pub. Date: Jan. 14, 2021

(65) Prior Publication Data

US 2022/0307430 A1 Sep. 29, 2022

(30) Foreign Application Priority Data

Jul. 11, 2019 (SE) ..... 1950884-5

(51) Int. Cl.
*F02D 13/04* (2006.01)
*F01L 9/10* (2021.01)
*F01L 13/06* (2006.01)

(52) U.S. Cl.
CPC ..... *F02D 13/04* (2013.01); *F01L 9/10* (2021.01); *F01L 13/065* (2013.01); *F01L 2800/01* (2013.01)

(58) Field of Classification Search
CPC . F02D 13/04; F01L 9/10; F01L 13/065; F01L 2800/01; F01L 2820/031; F01L 9/14; F01L 2001/2444
See application file for complete search history.

(56) References Cited

U.S. PATENT DOCUMENTS 3,220,392 A * 11/1965 Cummins ..... F01L 13/065 180/335
5,152,258 A 10/1992 D Alfonso
(Continued)

FOREIGN PATENT DOCUMENTS

EP 0034681 A1 * 9/1981
EP 1288489 A2 * 3/2003 ..... F01L 13/065
(Continued)

OTHER PUBLICATIONS

Scania CV AB, International Patent Application No. PCT/SE2020/050597, International Search Report, dated Jul. 28, 2020.
(Continued)

*Primary Examiner* — Hung Q Nguyen
(74) *Attorney, Agent, or Firm* — Moore & Van Allen PLLC; W. Kevin Ransom

(57) ABSTRACT

A control device and method for controlling a compression release brake arrangement is provided. The compression release brake arrangement comprises an exhaust valve actuator assembly, a first actuator valve and a second actuator valve. The method comprises controlling the first and second actuator valves to a first state in which one of the actuator valves is open and the other one is closed. The disclosure further relates to a computer program, a computer
(Continued)

readable medium, as well as to a vehicle comprising the control device.

12 Claims, 3 Drawing Sheets

(56) References Cited

U.S. PATENT DOCUMENTS

| | | | | |
|---|---|---|---|---|
| 5,479,890 | A * | 1/1996 | Hu | F02D 13/04 251/129.1 |
| 5,537,975 | A | 7/1996 | Cosma et al. | |
| 5,626,116 | A | 5/1997 | Reedy et al. | |
| 5,713,331 | A * | 2/1998 | Eisenbacher | F02M 63/0007 123/322 |
| 5,816,216 | A | 10/1998 | Egashira et al. | |
| 6,334,429 | B1 | 1/2002 | Little | |
| 2003/0116109 | A1 * | 6/2003 | Cotton, III | F01L 9/10 123/90.15 |
| 2010/0024767 | A1 * | 2/2010 | Meneely | F02D 13/04 123/323 |
| 2011/0197833 | A1 | 8/2011 | Vorih et al. | |
| 2012/0168654 | A1 | 7/2012 | Marriott | |
| 2016/0215661 | A1 | 7/2016 | Lou | |
| 2017/0175652 | A1 | 6/2017 | Ronnqvist et al. | |

FOREIGN PATENT DOCUMENTS

| | | | |
|---|---|---|---|
| JP | H09125995 | A | 5/1997 |
| WO | 2007064901 | A2 | 6/2007 |
| WO | 2014152944 | A1 | 9/2014 |
| WO | WO-2019151928 | A1 * | 8/2019 |

OTHER PUBLICATIONS

Scania CV AB, International Patent Application No. PCT/SE2020/050597, Written Opinion, dated Jul. 28, 2020.

Scania CV AB, International Patent Application No. PCT/SE2020/050597, International Preliminary Report on Patentability, dated Jan. 11, 2022.

* cited by examiner

CONTROL DEVICE AND METHOD FOR CONTROLLING A COMPRESSION RELEASE BRAKE ARRANGEMENT FOR AN ENGINE

CROSS-REFERENCE TO RELATED APPLICATIONS

This application is a National Stage Patent Application (filed under 35 § U.S.C. 371) of PCT/SE2020/050597, filed Jun. 10, 2020 of the same title, which, in turn claims priority to Swedish Patent Application No. 1950884-5 filed Jul. 11, 2019 of the same title; the contents of each of which are hereby incorporated by reference.

FIELD OF THE INVENTION

The present disclosure relates in general to a method for controlling a compression release brake arrangement for an engine. The present disclosure further relates in general to a control device configured to control a compression release brake arrangement for an engine. The present disclosure further relates in general to a computer program and a computer-readable medium. Moreover, the present disclosure relates in general to a vehicle comprising an engine and a compression release brake arrangement associated with the engine.

BACKGROUND OF THE INVENTION

A vehicle may comprise one or more auxiliary brakes. One example of an auxiliary brake is a compression release brake, sometimes also referred to as a Jacobs brake or a Jake brake. Compression release braking is based on opening one or more exhaust valves of an engine after the compression stroke so as to release compressed gas from the cylinders. Thereby, the energy stored in the compressed gases during the expansion stroke will not be returned to the crankshaft of the engine on the subsequent expansion stroke. This in turn results in a braking torque of the crankshaft of the engine, and consequently slowing down of the vehicle.

A compression release brake arrangement may be formed by a hydraulic system using for example engine oil as the hydraulic fluid. The compression release brake arrangement may typically comprise an exhaust valve actuator assembly configured to perform compression release braking of one or more cylinders of the engine when subjected to a hydraulic pressure above a threshold value. The compression release brake arrangement may further comprise a hydraulic arrangement comprising an actuator valve and a pump. The pump is typically driven by the engine of the vehicle and is thus dependent of the operation of the engine. The pump is typically configured to provide a hydraulic pressure, when the engine is running, which is above the above-mentioned threshold value. The actuator valve is configured to control the activation/deactivation of the exhaust valve actuator assembly. In an open state of the actuator valve, hydraulic fluid may be transferred to the exhaust valve actuator assembly at a pressure above the threshold value. When the actuator valve is closed, the hydraulic pressure will be reduced to a value below the threshold value, thus deactivating the exhaust valve actuator assembly and thereby terminating compression release braking.

The time it takes to activate compression release braking comprises a few delays, such delays comprising pure software delays, actuator valve activation delays, as well as time for filling the compression release braking arrangement with hydraulic fluid. The reason for the delay associated with the time for filling is that hydraulic fluid may leak out from various locations in a compression release brake arrangement. This in turn creates a delay in activation of compression release braking when the exhaust valve actuator assembly has been inactive for a longer period of time. Examples of such situations include, but is not limited to, when the vehicle has been at standstill during the night/weekend or during long driving cycles without usage of compression release braking. The above mentioned delays are added up to a total delay time for activation of compression release braking.

SUMMARY OF THE INVENTION

The object of the present invention is to enable a reduction of the time it takes to activate compression release braking upon a request for compression release braking.

The object is achieved by means of the subject-matter in accordance with the appended independent claims.

In accordance with the present disclosure, a method for controlling a compression release brake arrangement for an engine is provided. The method is performed by a control device. The compression release brake arrangement comprises an exhaust valve actuator assembly configured to, when activated, perform compression release braking of at least a first cylinder of the engine. The compression release brake arrangement further comprises a conduit. The conduit is fluidly connected to the exhaust valve actuator assembly. The conduit comprises a first actuator valve and a second actuator valve. The second actuator valve is arranged in parallel to the first actuator valve. The compression release brake arrangement further comprises at least one pump configured to supply hydraulic fluid via the conduit to the exhaust valve actuator assembly. The method comprises, in advance of activation of the exhaust valve actuator assembly, controlling the first actuator valve and the second actuator valve so as to achieve a first state in which one of the first actuator valve and the second actuator valve is in an open state whereas the other one of the first and the second actuator valve is in a closed state.

By means of controlling the first actuator valve and the second actuator valve so as to achieve the first state, hydraulic fluid will be allowed to flow into the arrangement so as to fill the conduit. Thereby, the delay in the activation of the compression release brake action after a request for compression release braking has been issued may be considerably reduced since the delay caused by the need to fill the arrangement with hydraulic fluid before the pressure can be increased has been minimized. At the same time, the hydraulic pressure in the conduit will be below a pressure which may risk activation the exhaust valve actuator assembly. Thereby, the risk of unintentional activation of compression release braking is minimized. This in turn minimizes the risk for disturbances in the operation of the vehicle. Furthermore, it avoids the risk for damages to the constituent components of the vehicle that may result from inappropriate activation of compression release braking.

The method may further comprise, after controlling the first actuator valve and the second actuator valve so as to achieve the first state, controlling the first actuator valve and the second actuator valve so as to achieve a second state in which both the first actuator valve and the second actuator valve are in a closed state. Thereby, it can be avoided that hydraulic fluid is continuously pumped into the entire conduit of the compression release brake arrangement. Furthermore, the risk for increasing the pressure above a threshold value which may risk unintentional activation of the exhaust valve actuator assembly may be minimized. Moreover, the power consumption for operation of the actuator valves may be minimized by allowing both the actuator valves to be in a closed state, when possible.

The step of controlling the first actuator valve and the second actuator valve so as to achieve the first state may be performed at predetermined intervals. Thereby, it is possible to ensure that the conduit may be sufficiently refilled to compensate for leakage of hydraulic fluid during operation of the engine. This in turn reduces the activation time for compression release braking when a request therefore has been issued.

The step of controlling the first actuator valve and the second actuator valve to the first state may be performed in response to information indicating that start-up of the engine has occurred. If the engine has been shut-off for a period of time, for example as a result of the vehicle being as standstill during the night/weekend, hydraulic fluid has likely leaked out from the conduit. This implies that the activation time for the compression release brake is long as a result of having to fill the conduit until the pressure can be increased to the threshold value at which the exhaust valve actuator assembly can be activated. By controlling the first and second actuator valves to the first state upon information that the engine has been started, the conduit is allowed to be prefilled such that the time to pressurise the hydraulic fluid in the conduit may be reduced.

The step of controlling the first actuator valve and the second actuator valve to the first state may be performed in response to information from a look-ahead system indicating an expected future desire to use compression release braking on the engine. Thereby, it can be ensured that the compression release brake arrangement is prefilled with hydraulic fluid when the compression release brake should be activated. Thus, activation time for compression release braking may be reduced without significant increase of parasitic hydraulic fluid flow losses.

The present disclosure further relates to a computer program, wherein said computer program comprises program code for causing a control device to perform the method described above.

The present disclosure further relates to a computer-readable medium comprising instructions, which when executed by a control device, cause the control device to perform the method as described above.

In accordance with the present disclosure, a control device configured to control a compression release brake arrangement for an engine is provided. The compression release brake arrangement comprises an exhaust valve actuator assembly configured to, when activated, perform compression release braking of at least a first cylinder of the engine. The compression release brake arrangement further comprises a conduit. The conduit is fluidly connected to the exhaust valve actuator assembly. The conduit comprises a first actuator valve and a second actuator valve. The second actuator valve is arranged in parallel to the first actuator valve. The compression release brake arrangement further comprises at least one pump configured to supply hydraulic fluid via the conduit to the exhaust valve actuator assembly. The control device is configured to, in advance of an activation of the exhaust valve actuator assembly, control the first actuator valve and the second actuator valve so as to achieve a first state in which one of the first actuator valve and the second actuator valve is in an open state whereas the other one of the first and the second actuator valve is in a closed state.

The control device provides the same advantages as disclosed above with regard to the corresponding method for controlling a compression release brake arrangement for an engine.

The control device may further be configured to, after controlling the first actuator valve and the second actuator valve so as to achieve the first state, control the first actuator valve and the second actuator valve so as to achieve a second state in which both the first actuator valve and the second actuator valve are in a closed state.

The control device may further be configured to control the first actuator valve and the second actuator valve so as to achieve the first state at predetermined intervals when the exhaust valve actuator assembly is not activated.

Furthermore, the control device may be configured to control the first actuator valve and the second actuator valve to the first state in response to information indicating that start-up of the engine has occurred.

Moreover, the control device may be configured to control the first actuator valve and the second actuator valve to the first state in response to information from a look-ahead system indicating an expected future desire to use compression release braking on the engine.

The present disclosure also relates to a vehicle comprising an engine and a compression release brake arrangement associated with the engine. The vehicle comprises a control device configured to control a compression release brake arrangement as described above.

DETAILED DESCRIPTION

Figure 1:
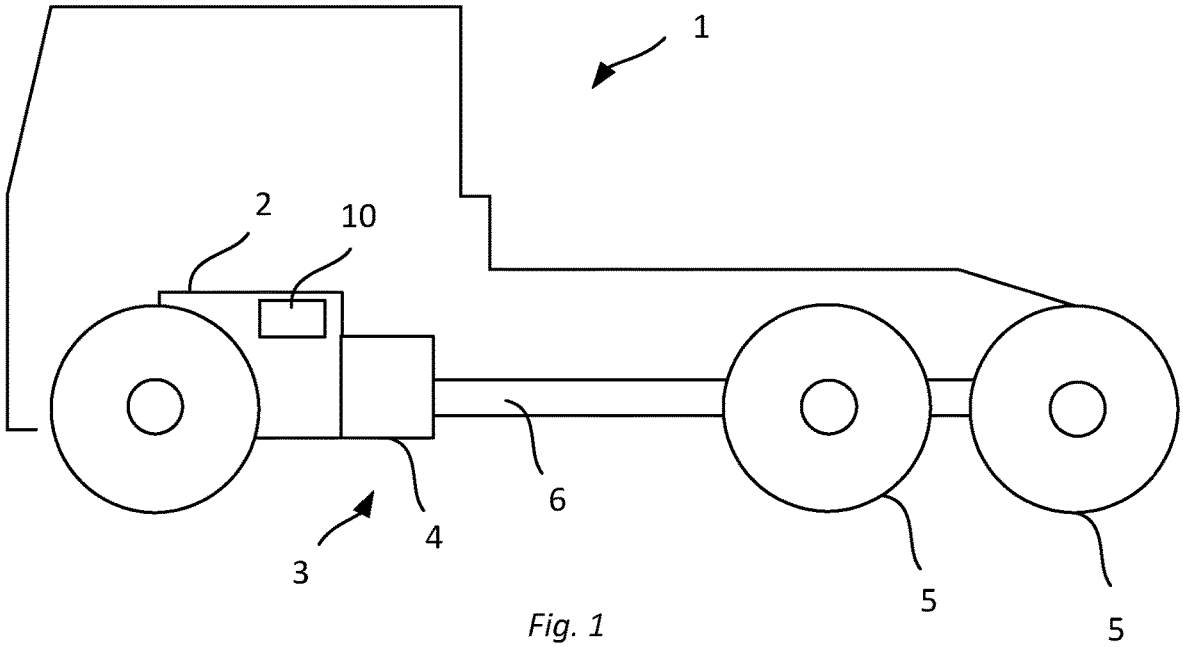
FIG. 1 schematically illustrates a side view of a vehicle according to one example.

The invention will be described in more detail below with reference to exemplifying embodiments and the accompanying drawings. The invention is however not limited to the exemplifying embodiments discussed and/or shown in the drawings, but may be varied within the scope of the appended claims. Furthermore, the drawings shall not be considered drawn to scale as some features may be exaggerated in order to more clearly illustrate the invention or features thereof.

When the terms "upstream" and "downstream" are used herein, they shall be considered in relation to the direction of flow of hydraulic fluid when the compression release brake arrangement is activated. In other words, they are used in reference to the flow direction trough the arrangement during compression release braking.

The present disclosure is directed to a method for control of a compression release brake arrangement associated with an engine, more specifically an engine of a vehicle. The method is performed by a control device. The compression release brake arrangement comprises an exhaust valve actuator assembly configured to, when activated, perform compression release braking of one or more cylinders of the engine. The compression release brake arrangement further comprises a conduit. The conduit is fluidly connected to the exhaust valve actuator assembly. The conduit comprises a first actuator valve and a second actuator valve. The first and second actuator valves may be configured to reduce the hydraulic pressure downstream of the respective actuator valves when in a closed state. The second actuator valve is arranged in parallel to the first actuator valve. The compression release brake arrangement further comprises at least one pump configured to supply hydraulic fluid via the conduit to the exhaust valve actuator assembly.

The method for controlling a compression release brake arrangement in accordance with the present disclosure comprises, in advance of activation of the exhaust valve actuator assembly, controlling the first actuator valve and the second actuator valve so as to achieve a first state. In said first state, one of the first actuator valve and the second actuator valve is in an open state whereas the other one of the first and the second actuator valve is in a closed state. In the present disclosure, "in advance of activation of the exhaust valve actuator assembly" shall be considered to mean at a point in time where compression release braking of the engine is not performed. It may be just before compression release braking of the engine is initiated or intended, or at any point in time at which there is no pending request for compression release braking. A request for compression release braking of the vehicle may be initiated by a driver of the vehicle, or by any control arrangement of the vehicle (for example a cruise control or the like).

The method for controlling a compression release brake arrangement according to the present disclosure may for example be initiated at any point in time at which it may be expected that hydraulic fluid at least partly has been leaked out from the conduit. This could typically be after a certain period of time after an active compression release brake action. For example, if the vehicle has not been operated for a period of time it is likely that hydraulic fluid has been leaked out of the conduit of the compression release braking arrangement. Furthermore, hydraulic fluid could also have leaked out of the conduit when the vehicle has been driven for a longer period of time without compression release braking.

The method may be initiated based on information indicating that start-up of the engine has occurred. In other words, the step of controlling the first actuator valve and the second actuator valve to the first state may be performed in response to information indicating that start-up of the engine has occurred.

The method may additionally, or alternatively, be initiated based on information relating to an expected future desire for compression release braking, such as information from a look-ahead system indicating an expected future desire to use compression release braking. The look-ahead system may be any previously known look-ahead system, such as a global positioning system in combination with map data, a camera in combination with image analysis, or the like. Information relating to an expected future desired for compression release braking may also be received from other sources, such as a vehicle-to-vehicle (V2V) communication system or any other vehicle-to-everything (V2X) communication system.

The method may further comprise, after controlling the first actuator valve and the second actuator valve so as to achieve the first state, controlling the first actuator valve and the second actuator valve so as to achieve a second state. In the second state, both the first actuator valve and the second actuator valve are in a closed state. By means of controlling the first and second actuator valves so as to achieve the second state hydraulic fluid will no longer be transferred to the conduit downstream of the actuator valves. The second state may be advantageous for example when there is no longer a need for further filling of the conduit. By controlling the first and second actuator valves so as to achieve the second state, the power consumption of the actuator valves may be reduced.

Furthermore, the risk of unintentionally increasing the pressure in the conduit to a level at which the exhaust valve actuator assembly may be activated may be minimized.

The step of controlling the first actuator valve and the second actuator valve so as to achieve the first state may be performed at predetermined intervals as long as there is no pending request for compression release braking. In other words, it may be performed continuously with a predetermined frequency. Each step of controlling the first and second actuator valves so as to achieve the first state may be alternated with steps of controlling the first and second actuator valves so as to achieve the second state.

According to one example, the method may comprise controlling the first actuator valve to an open state and the second actuator valve to a closed state, and thereafter controlling the first actuator to a closed state and the first actuator valve to an open state. In other words, which one of the first and second actuator valves are in the open state may be alternated. Thereby, there is less risk for unintentional effects if one of the actuator valves would be malfunctioning. Furthermore, it could thereby be possible to determine if one of the actuator valves are not operating as intended by usage of for example information from one or more sensors configured to determine hydraulic pressure in the conduit.

The method for controlling a compression release brake arrangement in accordance with the present disclosure is performed by a control device configured therefore. The control device is configured to, in advance of an activation of the exhaust valve actuator assembly, control the first actuator valve and the second actuator valve so as to achieve a first state in which one of the first actuator valve and the second actuator valve is in an open state whereas the other one of the first and the second actuator valve is in a closed state. The control device may further be configured to perform any one of the steps of the method for controlling a compression release brake arrangement as disclosed herein. The control device may also be configured to control the compression release brake arrangement so that a compression release braking action is performed, if desired. This may be achieved by controlling the first actuator valve and the second actuator valve to a third state in which both the first actuator valve and the second actuator valve are in an open state.

The control device may comprise one or more control units. In case of the control device comprising a plurality of control units, each control unit may be configured to control a certain function or a certain function may be divided between more than one control units.

The performance of the method for controlling a compression release brake arrangement as disclosed herein may be governed by programmed instructions. These programmed instructions typically take the form of a computer program which, when executed in or by a control device, causes the control device to effect desired forms of control action. Such instructions may typically be stored on a computer-readable medium.

FIG. 1 schematically illustrates a side view of an example of a vehicle 1. The vehicle 1 comprises a powertrain 3 comprising an internal combustion engine 2 and a gearbox 4. A clutch (not shown) may be arranged between the internal combustion engine 2 and the gearbox 4. The gearbox 4 is connected to the driving wheels 5 of the vehicle 1 via an output shaft 6 of the gearbox 4. The vehicle may further comprise a compression release brake arrangement 10 associated with the internal combustion engine 2. The compression release brake arrangement 10 is configured to allow compression release braking.

The vehicle 1 may be, but is not limited to, a heavy vehicle, e.g. a truck or a bus. Furthermore, the vehicle may be a hybrid vehicle comprising an electric machine (not shown) in addition to the internal combustion engine 2.

Figure 2:
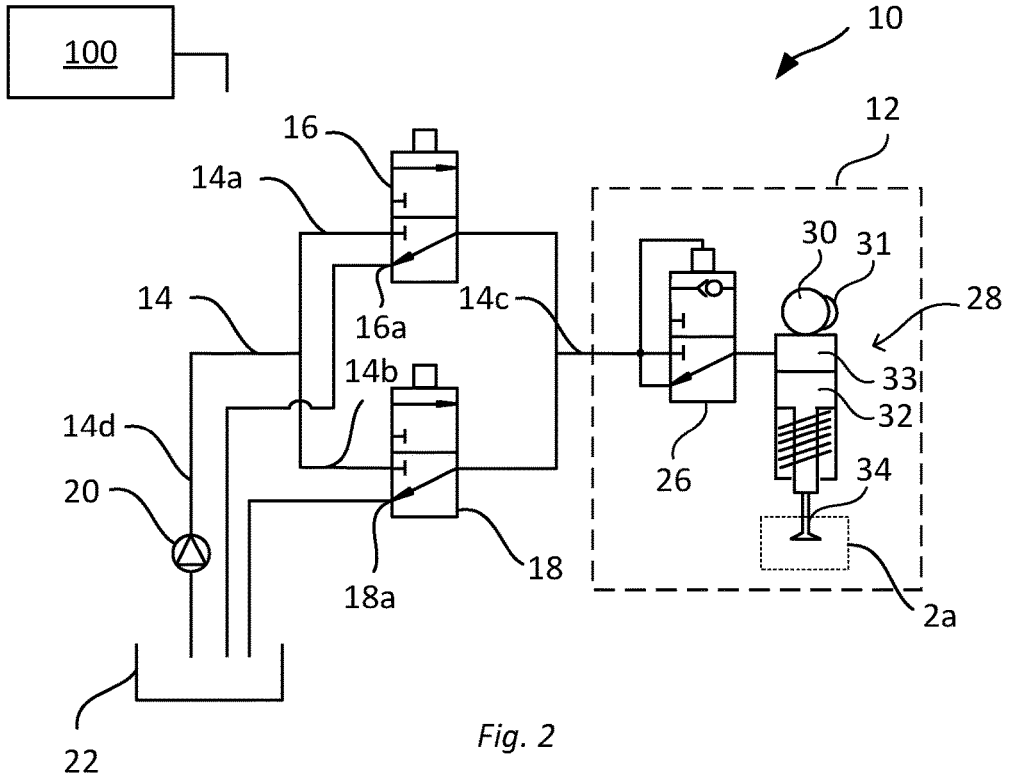
FIG. 2 schematically illustrates a compression release brake arrangement according to one exemplifying embodiment.

FIG. 2 schematically illustrates a compression release brake arrangement 10 according to one exemplifying embodiment. The compression release brake arrangement 10 is configured to selectively perform compression release braking of an engine, such as the internal combustion engine 2 of the vehicle 1 illustrated in FIG. 1.

The compression release brake arrangement 10 comprises an exhaust valve actuator assembly 12 configured to, when activated, perform compression release braking of at least a first cylinder 2*a* of the engine. In FIG. 2, the first cylinder 2*a* is schematically illustrated as a dotted box. The exhaust valve actuator assembly 12 may be connected to any one of the cylinders of the engine. The compression release brake arrangement 10 further comprises a conduit 14 fluidly connecting a reservoir 22 for hydraulic fluid with the exhaust valve actuator assembly 12. The conduit 14 is thus arranged to allow flow of hydraulic fluid from the reservoir 22 to the exhaust valve actuator assembly 12 when compression release braking is to be performed. The conduit 14 is further configured to allow flow in the reverse direction, i.e. from the exhaust valve actuator assembly 12 towards the reservoir 12, when there is no need for compression release braking. The compression release brake arrangement 10 further comprises a pump 20 configured to supply hydraulic fluid via the conduit 14 to the exhaust valve actuator assembly 12 at a desired hydraulic pressure.

In FIG. 2, only one exhaust valve actuator assembly 12 is illustrated. It should however be noted that the compression release brake arrangement 10 may comprise a plurality of exhaust valve actuator assemblies 12, each such exhaust valve actuator assembly being associated with a respective cylinder of the engine. Alternatively, the exhaust valve actuator assembly 12 may be associated with a plurality of the cylinders of the engine. Furthermore, in case of a cylinder of the engine comprising more than one exhaust valve, a first exhaust valve actuator assembly 12 may be associated with a first exhaust valve of the cylinder. In such a case, a second exhaust valve actuator assembly may optionally be associated with a second exhaust valve of the cylinder.

The exhaust valve actuator assembly 12 is configured to be activated when subjected to a fluid pressure above a pre-determined threshold value, and deactivated when subjected to a fluid pressure below the predetermined threshold value, as will be described in more detail below.

The exhaust valve actuator assembly 12 comprises a compression release brake valve 26 and an exhaust valve actuator 28. The compression release brake valve 26 is fluidly connected to the conduit 14. The exhaust valve actuator 28 comprises a portion of a camshaft 30, which in turn comprises at least one cam lobe 31. The camshaft 30 is configured to rotate upon rotation of a crankshaft of the engine. The exhaust valve actuator 28 further comprises a hydraulic component 32 comprising a fluid chamber 33.

The compression release brake valve 26 may be configured to assume a first open state when the hydraulic pressure in the conduit 14 is above a predetermined threshold value. The compression release brake valve 26 may further be configured to assume a second closed state when the hydraulic pressure in the conduit 14 is below the predetermined threshold value. When the compression release brake valve 26 is in an open state, it allows transport of hydraulic fluid into the fluid chamber 33. Thus, the fluid chamber 33 is thereby filled with hydraulic fluid when the compression release brake valve is in the first open state. Furthermore, when the compression release brake valve is in the first open state, the compression release brake valve also hinders transport of hydraulic fluid out of the fluid chamber 33. As a result thereof, when the cam lobe 31 abuts against the hydraulic component 32, an exhaust valve 34 of the engine is opened. This because the motion of the cam lobe 31 can be transferred to an opening motion of the exhaust valve 34. The camshaft 30 and the cam lobe 31 are arranged such that the opening of the exhaust valve 34 occurs towards the end of a compression stroke of the first cylinder 2*a*. As a result, gases compressed during the compression stroke are released from the first cylinder 2*a*. Thereby, compression release braking is provided.

The conduit 14 may be described as comprising a first conduit second 14*a*, a second conduit section 14*b*, a third conduit section 14*c* and a fourth conduit section 14*d*. The first and second conduit sections 14*a*, 14*b* are arranged in parallel to each other, and thus allow parallel flow of hydraulic fluid in a part of the conduit 14. The first and second conduit sections 14*a* and 14*b* of the conduit 14 are combined into the third conduit section 14*c* upstream of the exhaust valve actuator assembly 12. The fourth conduit section 14*d* is arranged upstream of the first and second conduit sections 14*a*, 14*b*, such that the fourth conduit section 14*d* is divided into the first and second conduit sections 14*a*, 14*b* upstream of the exhaust valve actuator assembly 12. The first conduit section 14*a* thus connects the fourth conduit section 14*d* with the third conduit section 14*c*. Furthermore, also the second conduit section 14*b* thus connects the fourth conduit section 14*d* with the third conduit section 14*c*. The fourth conduit section 14*d* may be connected to the reservoir 22. Furthermore, the pump 20 may be arranged in the fourth conduit section 14*d*.

The compression release brake arrangement further comprises a first valve actuator 16 and a second valve actuator 18 arranged in the conduit 14. The first valve actuator 16 and the second valve actuator 18 may be arranged downstream of the pump. Furthermore, the first and second valve actuators 16, 18 are arranged upstream of the exhaust valve actuator assembly 12. Moreover, the second valve actuator 18 is arranged in parallel with the first valve actuator 16. In other words, the first and second valve actuators 16, 18 are arranged in the respective first and second conduit sections 14*a*, 14*b* of the conduit 14. The first actuator valve 16 and the second actuator valve 18 are configured to control flow of hydraulic fluid in the conduit 14 and thus control the operation of the exhaust valve actuator assembly 12. The first and second actuator valves 16, 18 may each be a 3-2 solenoid valve.

The pressure supplied by the pump 20 may be above the above the predetermined threshold value for opening the compression release brake valve 26 when the engine is running. The first and second actuator valves 16, 18 are arranged to open/close a respective fluid connection between the fourth conduit section 14*d* and the third conduit section 14*c*, i.e. through the first conduit section 14*a* or second conduit section 14*b*, respectively.

When the first actuator valve 16 and the second actuator valve 18 are both in an open state, the exhaust valve actuator assembly 12 may be activated. This is due to the exhaust valve actuator assembly 12 being subjected to a hydraulic pressure supplied by the pump 20 which pressure is above the predetermined threshold value. However, when at least one of the first actuator valve 16 and the second actuator valve 18 are in a closed state, the exhaust valve actuator assembly 12 is in a deactivated state. Thus, the purpose of arranging the first and second actuator valves 16, 18 in parallel is to enable deactivation of the exhaust valve actuator assembly 12 by closing only one of the first and second actuator valves 16, 18. In other words, the purpose of having two actuator valves is to increase the safety of the compression release brake arrangement 10 by allowing termination of compression release braking by closing only one of the actuator valves if the other one of the actuator valves is not functioning properly. Thus, although it is not necessary to have two actuator valves for the purpose of performing compression release braking by means of a compression release brake arrangement, the presence of two actuator valves 16, 18 improves the operation and safety of the compression release brake arrangement.

More specifically, the first actuator valve 16 and the second actuator valve 18 are each configured so as to enable reducing the hydraulic pressure in the conduit 14 downstream of the respective actuator valve. This may be achieved by a respective pressure reducer 16*a*, 18*a*. The pressure reducers 16*a*, 18*a* are configured to open a connection between the conduit upstream of the first and second actuator valves, i.e. third conduit section 14*c*, and a portion of the compression release brake arrangement having a lower pressure, such as the reservoir 22 as shown in FIG. 2. Thereby, the exhaust valve actuator assembly 12 will cancel compression release braking when one of, or both, the first and second actuator valves 16, 18 are closed.

The compression release brake arrangement 10 may, if desired, comprise further actuator valves in addition to the first and second actuator valves 16, 18. For example, the first conduit section 14*a* and/or the second conduit section 14*b* may comprise two actuator valves arranged in series. Furthermore, the compression release brake arrangement 10 may comprise one or more further actuator valves arranged in parallel to the first and second actuator valves 16, 18.

Although not illustrated in FIG. 2, the compression release brake arrangement may further comprise one or more sensors configured to determine the hydraulic pressure in the conduit. By means of such a sensor, it may for example be possible to determine that the conduit 14 has been drained from hydraulic fluid between the actuator valves 16, 18 and the exhaust valve actuator assembly 12.

The compression release brake arrangement 10 further comprises a control device 100 configured to control the compression release brake arrangement 10. The control device is connected to the first actuator valve 16 and to the second actuator valve 18 for the purpose of control thereof. The control device 100 may also be connected to at least one sensor configured to determine hydraulic pressure in the conduit 14. Thus, the control device may be configured to receive information regarding hydraulic pressure in the conduit 14 and to control the first and second actuator valves 16, 18 in dependence of such information. The control device may further be connected to other constituent components of the compression release brake arrangement 10, as well as the engine 2 or an engine control device. The control device may for example be configured to determine or receive information regarding a duration since the last compression release braking action has been performed.

The time it takes to activate compression release braking comprises a few delays, such delays comprising pure software delays, actuator valve activation delays, as well as time for filling the conduit 14 with hydraulic fluid. These delays are added up to a total delay time for activation of compression release braking. As previously mentioned in the background section of the present disclosure, hydraulic fluid may leak out from various locations in a compression release brake arrangement, for example parts of the conduit and/or cavities formed in or between constituent components of the arrangement. This in turn creates a delay when the exhaust valve actuator assembly 12 has not been activated for a longer period of time. Examples of such situations include, but is not limited to, when the vehicle has been at standstill during the night/weekend or during long driving cycles without usage of compression release braking. The delay comes from the need for the hydraulic fluid to flow into the partly or completely empty conduit 14 before a pressure increase can be achieved. The method as disclosed herein reduces the delay in the increase of pressure in the conduit by controlling the first actuator valve and the second actuator valve such that a pre-filling of the conduit section downstream of the first and second actuator valves is achieved prior to compression release braking. It has been found that by means of usage of the present method, the total activation time of compression release braking can be at least about 5-10 times shorter (depending on the specific circumstances relating to the point in time at which compression release braking is requested) than the conventional total activation time of compression release braking.

Figure 3:
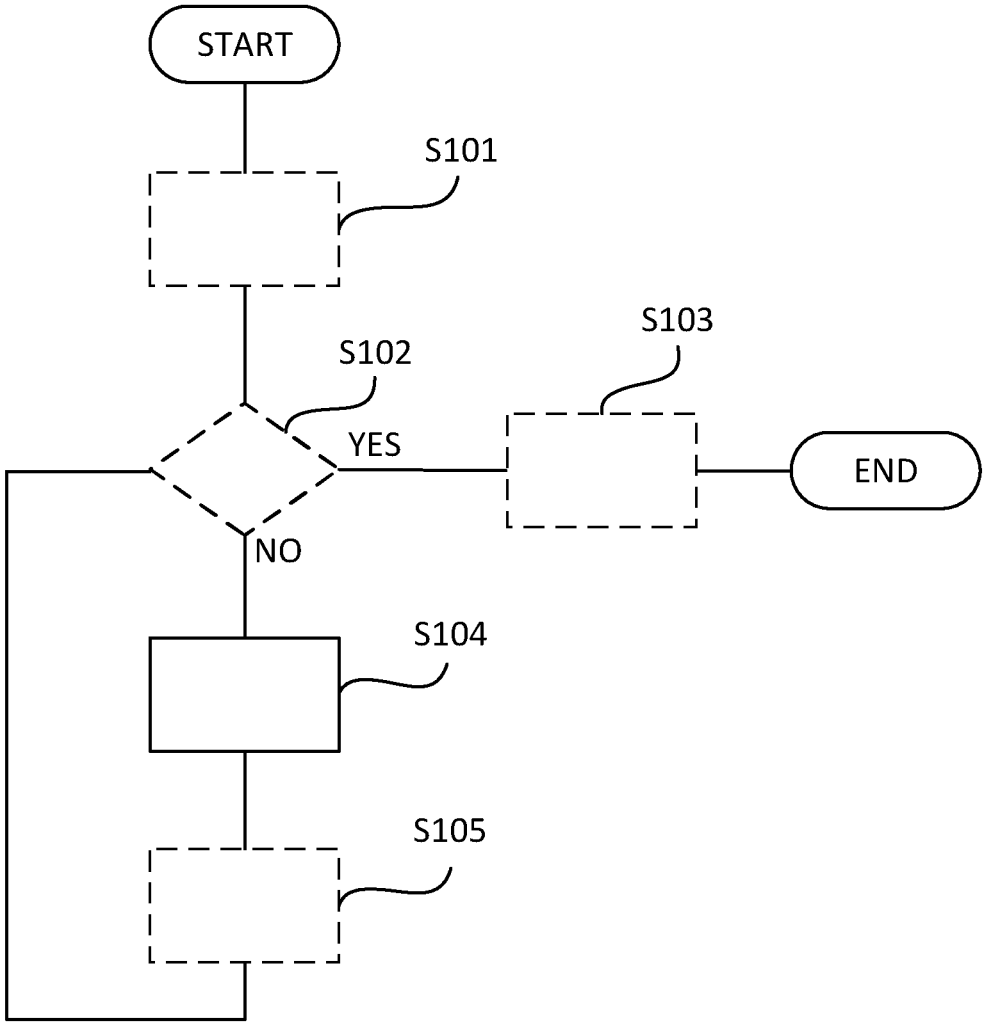
FIG. 3 represents a flowchart schematically illustrating a method for controlling a compression release brake arrangement according to an exemplifying embodiment.

FIG. 3 represents a flowchart schematically illustrating a method for controlling a compression release brake arrangement, such as the one disclosed above with reference to FIG. 2, according to one exemplifying embodiment. In the figure, optional steps are illustrated by dashed shapes. The method may comprise one or more of the optional steps in any combination.

The method may comprise a first step S101 of determining a condition indicative of a need to fill the conduit of the compression release brake arrangement before a hydraulic pressure therein can be increased to a value sufficient for activation of the exhaust valve actuator assembly. The step S101 may for example comprise determining that there conduit is empty or only partially filled with hydraulic fluid, or determining a parameter which indicates an expected need for filling the conduit. The latter may for example comprise determining that a certain period of time has lapsed since a preceding compression release braking action. The step S101 may comprise determining the condition indicative of a need to fill the conduit by receiving information indicating that start-up of the engine has occurred. The step S101 may comprise determining the condition indicative of a need to fill the conduit based on information from a look-ahead system indicating an expected future desire to use compression release braking on the engine.

The method may further comprise a step S102 of determining whether there is a pending request for compression release braking. Such a request may be issued by any previously known method therefore. For example, a request for compression release braking may be issued by a cruise control of the vehicle, or by a driver of the vehicle. In case there is a pending request for compression release braking, the method may be proceeded to a step S103 as will be described below. In case there is no pending request for compression release braking, the method may proceed to step S104 which will be described below.

The method may comprise a step S103 of controlling the first actuator valve and the second actuator valve so as to achieve a third state. In the third state, both the first actuator valve and the second actuator valve are in an open state. Thereby, the exhaust valve actuator assembly is activated and compression release braking thus performed. The method may be ended after step S103.

The method comprises a step S104 of controlling the first actuator valve and the second actuator valve so as to achieve a first state. In the first state, one of the first actuator valve and the second actuator valve is in an open state whereas the other one of the first actuator valve and the second actuator valve is in a closed state. Step 104 is performed in advance of an activation of the exhaust valve actuator assembly. In other words, step S104 is performed when compression release braking is not performed.

Step S104 may be followed by a step S105 of controlling the first actuator valve and the second actuator valve so as to achieve a second state. In the second state, both the first actuator valve and the second actuator valve are in a closed state. Thereby, no hydraulic fluid is transferred to the exhaust valve actuator assembly.

After step S104 and the optional step S105, the method may be returned to the optional step S102.

In case the method does not comprise the optional steps, the method may be ended after step S104 and the optional step S105.

Figure 4:
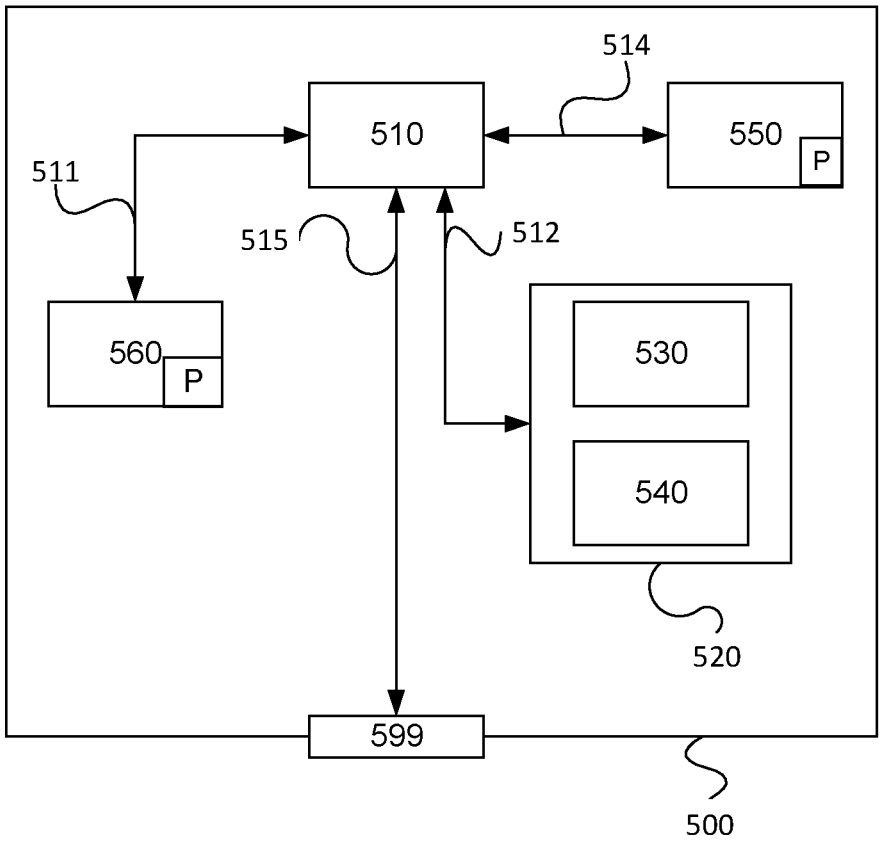
FIG. 4 schematically illustrates a device that may constitute, comprise or be a part of a control device configured to control a compression release brake arrangement.

FIG. 4 schematically illustrates an exemplifying embodiment of a device 500. The control device 100 described above may for example comprise the device 500, consist of the device 500, or be comprised in the device 500.

The device 500 comprises a non-volatile memory 520, a data processing unit 510 and a read/write memory 550. The non-volatile memory 520 has a first memory element 530 in which a computer program, e.g. an operating system, is stored for controlling the function of the device 500. The device 500 further comprises a bus controller, a serial communication port, I/O means, an A/D converter, a time and date input and transfer unit, an event counter and an interruption controller (not depicted). The non-volatile memory 520 has also a second memory element 540.

There is provided a computer program P that comprises instructions for controlling a compression release brake arrangement for an engine. The compression release brake arrangement comprises an exhaust valve actuator assembly configured to, when activated, perform compression release braking of at least a first cylinder of the engine. The compression release brake arrangement further comprises a conduit. The conduit is fluidly connected to the exhaust valve actuator assembly. The conduit comprises a first actuator valve and a second actuator valve. The second actuator valve is arranged in parallel to the first actuator valve. The compression release brake arrangement further comprises at least one pump configured to supply hydraulic fluid via the conduit to the exhaust valve actuator assembly. The computer program P comprises instructions for, in advance of an activation of the exhaust valve actuator assembly, controlling the first actuator valve and the second actuator valve so as to achieve a first state in which one of the first actuator valve and the second actuator valve is in an open state whereas the other one of the first and the second actuator valve is in a closed state. The computer program P may further comprise instructions for, after controlling the first actuator valve and the second actuator valve so as to achieve the first state, controlling the first actuator valve and the second actuator valve so as to achieve a second state in which both the first actuator valve and the second actuator valve are in a closed state.

The program P may be stored in an executable form or in a compressed form in a memory 560 and/or in a read/write memory 550.

The data processing unit 510 may perform one or more functions, i.e. the data processing unit 510 may effect a certain part of the program P stored in the memory 560 or a certain part of the program P stored in the read/write memory 550.

The data processing device 510 can communicate with a data port 599 via a data bus 515. The non-volatile memory 520 is intended for communication with the data processing unit 510 via a data bus 512. The separate memory 560 is intended to communicate with the data processing unit 510 via a data bus 511. The read/write memory 550 is adapted to communicate with the data processing unit 510 via a data bus 514. The communication between the constituent components may be implemented by a communication link. A communication link may be a physical connection such as an optoelectronic communication line, or a non-physical connection such as a wireless connection, e.g. a radio link or microwave link.

When data are received on the data port 599, they may be stored temporarily in the second memory element 540. When input data received have been temporarily stored, the data processing unit 510 is prepared to effect code execution as described above.

Parts of the methods herein described may be effected by the device 500 by means of the data processing unit 510 which runs the program stored in the memory 560 or the read/write memory 550. When the device 500 runs the program, methods herein described are executed.

The invention claimed is:

1. A method for controlling a compression release brake arrangement for an engine the compression release brake arrangement comprising:

an exhaust valve actuator assembly configured to, when activated, perform compression release braking of at least a first cylinder of the engine;

a conduit fluidly connected to the exhaust valve actuator assembly; the conduit comprising a first actuator valve and a second actuator valve, the second actuator valve arranged in parallel to the first actuator valve; and at least one pump configured to supply hydraulic fluid via the conduit to the exhaust valve actuator assembly; the method performed by a control device and comprising:

in advance of an activation of the exhaust valve actuator assembly, controlling the first actuator valve and the second actuator valve so as to achieve a first state in which one of the first actuator valve and the second actuator valve is in an open state whereas the other one of the first and the second actuator valves is in a closed state.

2. The method according to claim 1, further comprising:

after controlling the first actuator valve and the second actuator valve so as to achieve the first state, controlling the first actuator valve and the second actuator valve so as to achieve a second state in which both the first actuator valve and the second actuator valve are in a closed state.

3. The method according to claim 1, wherein controlling the first actuator valve and the second actuator valve so as to achieve the first state is performed at predetermined intervals.

4. The method according to claim 1, wherein controlling the first actuator valve and the second actuator valve to the first state is performed in response to information indicating that start-up of the engine has occurred.

5. The method according to claim 1, wherein controlling the first actuator valve and the second actuator valve to the first state is performed in response to information from a look-ahead system indicating an expected future desire to use compression release braking on the engine.

6. A computer program code stored on a non-transitory computer-readable medium, said computer program product used for controlling a compression release brake arrangement for an engine the compression release brake arrangement comprising: an exhaust valve actuator assembly configured to, when activated, perform compression release braking of at least a first cylinder of the engine; a conduit fluidly connected to the exhaust valve actuator assembly; the conduit comprising a first actuator valve and a second actuator valve, the second actuator valve arranged in parallel to the first actuator valve; and at least one pump configured to supply hydraulic fluid via the conduit to the exhaust valve actuator assembly, said computer program code comprising computer instructions to cause one or more control devices to perform the following operations:

in advance of an activation of the exhaust valve actuator assembly, controlling the first actuator valve and the second actuator valve so as to achieve a first state in which one of the first actuator valve and the second actuator valve is in an open state whereas the other one of the first and the second actuator valves is in a closed state.

7. A control device configured to control a compression release brake arrangement for an engine, the compression release brake arrangement comprising:

an exhaust valve actuator assembly configured to, when activated, perform compression release braking of at least a first cylinder of the engine;

a conduit fluidly connected to the exhaust valve actuator assembly;

the conduit comprising a first actuator valve and a second actuator valve, the second actuator valve arranged in parallel to the first actuator valve; and at least one pump configured to supply hydraulic fluid via the conduit to the exhaust valve actuator assembly;

the control device configured to, in advance of an activation of the exhaust valve actuator assembly, control the first actuator valve and the second actuator valve so as to achieve a first state in which one of the first actuator valve and the second actuator valve is in an open state whereas the other one of the first and the second actuator valve is in a closed state.

8. The control device according to claim 7, further configured to, after controlling the first actuator valve and the second actuator valve so as to achieve the first state, control the first actuator valve and the second actuator valve so as to achieve a second state in which both the first actuator valve and the second actuator valve are in a closed state.

9. The control device according to claim 7, further configured to control the first actuator valve and the second actuator valve so as to achieve the first state at predetermined intervals when the exhaust valve actuator assembly is not activated.

10. The control device according to claim 7, further configured to control the first actuator valve and the second actuator valve to the first state in response to information indicating that start-up of the engine has occurred.

11. The control device according to claim 7, further configured to control the first actuator valve and the second actuator valve to the first state in response to information from a look-ahead system indicating an expected future desire to use compression release braking on the engine.

12. A vehicle comprising:

an engine; and a compression release brake arrangement associated with the engine, wherein the compression release brake arrangement comprises: an exhaust valve actuator assembly configured to, when activated, perform compression release braking of at least a first cylinder of the engine; a conduit fluidly connected to the exhaust valve actuator assembly; the conduit comprising a first actuator valve and a second actuator valve, the second actuator valve arranged in parallel to the first actuator valve; and at least one pump configured to supply hydraulic fluid via the conduit to the exhaust valve actuator assembly; and one or more control devices to perform the following operations of in advance of an activation of the exhaust valve actuator assembly, controlling the first actuator valve and the second actuator valve so as to achieve a first state in which one of the first actuator valve and the second actuator valve is in an open state whereas the other one of the first and the second actuator valves is in a closed state.

* * * * *